US012012841B2

(12) United States Patent
Madhireddy et al.

(10) Patent No.: US 12,012,841 B2
(45) Date of Patent: Jun. 18, 2024

(54) AUTOMATICALLY DETECTING AND UNWINDING ACCUMULATED DRILL STRING TORQUE

(71) Applicant: Schlumberger Technology Corporation, Sugar Land, TX (US)

(72) Inventors: Ramakrishna Madhireddy, Cypress, TX (US); Wenshuai Hou, Richmond, TX (US); Seetharam Kothuru, Cypress, TX (US); Jian Wu, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 62 days.

(21) Appl. No.: 17/906,540

(22) PCT Filed: Mar. 15, 2021

(86) PCT No.: PCT/US2021/022357

§ 371 (c)(1),
(2) Date: Sep. 16, 2022

(87) PCT Pub. No.: WO2021/188432

PCT Pub. Date: Sep. 23, 2021

(65) Prior Publication Data

US 2023/0184082 A1 Jun. 15, 2023

Related U.S. Application Data

(60) Provisional application No. 62/991,088, filed on Mar. 18, 2020.

(51) Int. Cl.

| | |
|---|---|
| ***E21B 44/04*** | (2006.01) |
| ***E21B 3/02*** | (2006.01) |
| ***E21B 47/12*** | (2012.01) |

(52) U.S. Cl.
CPC ..... *E21B 44/04* (2013.01); *E21B 3/022* (2020.05); *E21B 47/12* (2013.01)

(58) Field of Classification Search
CPC ..... E21B 44/04; E21B 3/022; E21B 47/12; E21B 3/02
See application file for complete search history.

(56) References Cited

U.S. PATENT DOCUMENTS 9,784,035 B2 * 10/2017 Boone ..... E21B 7/04
9,792,571 B1 * 10/2017 Mandava ..... G06Q 10/06
(Continued)

FOREIGN PATENT DOCUMENTS

CN 109025800 A 12/2018
EP 2288783 B1 2/2016
(Continued)

OTHER PUBLICATIONS

Search Report and Written Opinion of International Patent Application No. PCT/US2021/022357 on Jun. 28, 2021; 12 pages.

*Primary Examiner* — Steven A MacDonald
(74) *Attorney, Agent, or Firm* — Jeffrey D. Frantz

(57) ABSTRACT

Methods, apparatus, and products for receiving measurements indicative of present value torque (TrqPv) currently being applied by a top drive to a drill string extending in a well that penetrates a subterranean formation, and releasing torque accumulated in the drill string by determining polarity of TrqPv and, in response to a manual or automatic trigger, causing the top drive to perform an unwinding operation in a direction opposite to the determined TrqPv polarity.

17 Claims, 5 Drawing Sheets

(56) References Cited

U.S. PATENT DOCUMENTS

| | | | | |
|---|---|---|---|---|
| 10,954,773 | B2 * | 3/2021 | Benson | E21B 7/04 |
| 11,414,978 | B2 * | 8/2022 | Weideman | E21B 7/06 |
| 11,466,556 | B2 * | 10/2022 | Hopwood | E21B 44/00 |
| 11,655,701 | B2 * | 5/2023 | Forshaw | E21B 44/04 175/27 |
| 2005/0194183 | A1 * | 9/2005 | Gleitman | E21B 17/07 175/45 |
| 2019/0218901 | A1 * | 7/2019 | Groover | E21B 47/00 |
| 2019/0301273 | A1 * | 10/2019 | Gillan | E21B 44/04 |
| 2021/0277748 | A1 * | 9/2021 | Rajagopalan | E21B 47/12 |
| 2022/0356797 | A1 * | 11/2022 | Hopwood | E21B 47/024 |

FOREIGN PATENT DOCUMENTS

| | | | |
|---|---|---|---|
| WO | 2018152636 | A1 | 8/2018 |
| WO | 2019050824 | A1 | 3/2019 |

* cited by examiner

AUTOMATICALLY DETECTING AND UNWINDING ACCUMULATED DRILL STRING TORQUE

CROSS-REFERENCE TO RELATED APPLICATIONS

This application is the National Stage Entry of International Application No. PCT/US2021/022357, filed Mar. 15, 2021, which claims priority to and the benefit of U.S. Provisional Application No. 62/991,088, titled "AUTOMATICALLY DETECTING AND UNWINDING TRAPPED DRILL STRING TORQUE," filed Mar. 18, 2020, the entire disclosure of which is hereby incorporated herein by reference.

BACKGROUND OF THE DISCLOSURE

Many oil/gas drilling rigs utilize a top drive that moves vertically along a derrick while simultaneously providing torque that rotates a drill string so that a drill bit at the lower end of the drill string drills through subterranean formations. Depending upon friction along the wellbore and formation changes, the drill bit (and perhaps a bottom hole assembly (BHA) to which the drill bit is coupled) may get stuck, resulting in an uncontrollable back spin of drill pipes forming the lower portion of the drill string. A more common occurrence is the buildup of torque accumulated (i.e., stored) in the drill string, also resulting in uncontrollable back spin of the lower drill string.

During rotary drilling operations, depending on forward or reverse rotation of the drill string, torque can build up in the opposite direction of the rotation of the drill string. Such torque buildup acts on the drill string and can cause an unintended and perhaps uncontrollable backspin of the drill string. Current operations for unwinding torque accumulated in the drill string require a predetermined positive or negative speed setpoint at which the drill string is intended to be unwound, thereby preventing the drill string to be unwound in a direction opposite from the direction of rotation of the drill string. Current operations and equipment also do not satisfactorily permit unwinding of torque accumulated in the drill string. For example, current operations for unwinding torque accumulated in the drill string include decreasing the rotational speed of a top drive to a very low positive torque setpoint and then decreasing torque output limit of the top drive to zero systematically and at a predetermined rate. Other current operations for unwinding torque accumulated in the drill sting includes switching the top drive to a low negative torque setpoint. After the intended values of such operational parameters of the top drive are achieved, the drill string can unwind in a controlled manner and the unwinding operation is deemed completed. Current operations for unwinding torque accumulated in the drill string need to be initiated by a human operator, which will not help when a large torque builds up downhole within the drill string and causes an uncontrollable backspin of the drill string. Current operations for unwinding torque accumulated in the drill string also utilize a fixed unwinding speed, which can lead to a substantial period of time to unwind the accumulated torque in the drill string and, depending on downhole conditions, may not even unwind the accumulated torque.

SUMMARY OF THE DISCLOSURE

This summary is provided to introduce a selection of concepts that are further described below in the detailed description. This summary is not intended to identify indispensable features of the claimed subject matter, nor is it intended for use as an aid in limiting the scope of the claimed subject matter.

The present disclosure introduces a method including initiating operation of a control device to thereby receive measurements indicative of present value torque (TrqPv) currently being applied by a top drive to a drill string extending in a well that penetrates a subterranean formation. The method also includes utilizing the operating control device to release torque accumulated in the drill string by determining polarity of TrqPv and, in response to a manual or automatic trigger, causing the top drive to perform an unwinding operation in a direction opposite to the determined TrqPv polarity.

The present disclosure also introduces an apparatus including a torque sensor and a control device. The torque sensor facilitates torque measurements indicative of present value torque (TrqPv) currently being applied by a top drive to a drill string extending in a well that penetrates a subterranean formation. The control device includes a processor and a memory storing computer program code. The computer program code, when executed by the processor, causes the control device to receive the TrqPv measurements and release torque accumulated in the drill string by determining polarity of TrqPv and, in response to a manual or automatic trigger, causing the top drive to perform an unwinding operation in a direction opposite to the determined TrqPv polarity.

The present disclosure also introduces a computer program product including a tangible, non-transitory, computer-readable medium having instructions stored thereon that, when executed by a processor of a control device, cause the control device to receive measurements indicative of present value torque (TrqPv) currently being applied by a top drive to a drill string extending in a well that penetrates a subterranean formation, and to release torque accumulated in the drill string by determining polarity of TrqPv and, in response to a manual or automatic trigger, causing the top drive to perform an unwinding operation in a direction opposite to the determined TrqPv polarity.

These and additional aspects of the present disclosure are set forth in the description that follows, and/or may be learned by a person having ordinary skill in the art by reading the material herein and/or practicing the principles described herein. At least some aspects of the present disclosure may be achieved via means recited in the attached claims.

BRIEF DESCRIPTION OF THE DRAWINGS

The present disclosure is understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
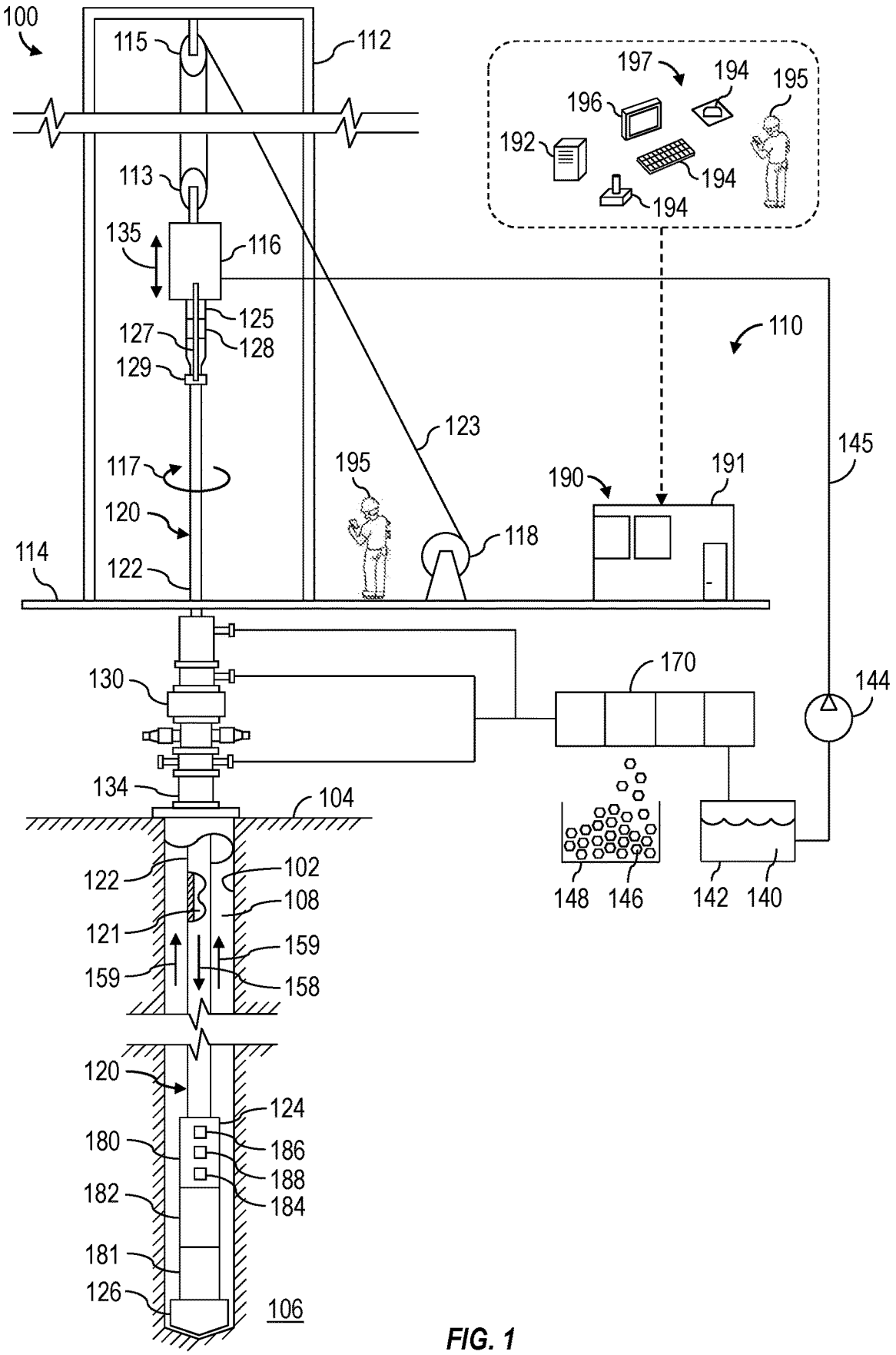
FIG. 1 is a schematic view of at least a portion of an example implementation of apparatus according to one or more aspects of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for simplicity and clarity, and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

FIG. 1 is a schematic view of at least a portion of an example implementation of a well construction system 100 according to one or more aspects of the present disclosure. The well construction system 100 represents an example environment in which one or more aspects of the present disclosure described below may be implemented. The well construction system 100 may be or comprise a drilling rig and associated equipment. Although the well construction system 100 is depicted as an onshore implementation, the aspects described below are also applicable to offshore implementations.

The well construction system 100 is depicted in relation to a wellbore 102 formed by rotary and/or directional drilling from a wellsite surface 104 and extending into a subterranean formation 106. The well construction system 100 comprises well construction equipment, such as surface equipment 110 located at the wellsite surface 104 and a drill string 120 suspended within the wellbore 102. The surface equipment 110 may include a mast, a derrick, and/or another support structure 112 disposed over a rig floor 114. The drill string 120 may be suspended within the wellbore 102 from the support structure 112. The support structure 112 and the rig floor 114 are collectively supported over the wellbore 102 by legs and/or other support structures (not shown). Certain pieces of surface equipment 110 may be manually operated (e.g., by hand, via a local control panel, etc.) by rig personnel 195 (e.g., a roughneck or another human rig operator) located at various portions (e.g., rig floor 114) of the well construction system 100.

The drill string 120 may comprise a bottom-hole assembly (BHA) 124 and means 122 for conveying the BHA 124 within the wellbore 102. The conveyance means 122 may comprise drill pipe, heavy-weight drill pipe (HWDP), wired drill pipe (WDP), tough logging condition (TLC) pipe, and/or other means for conveying the BHA 124 within the wellbore 102. A downhole end of the BHA 124 may include or be coupled to a drill bit 126. Rotation of the drill bit 126 and the weight of the drill string 120 collectively operate to form the wellbore 102. The drill bit 126 may be rotated via operation of a top drive 116 at the wellsite surface 104 and/or via operation of a downhole mud motor 182 operatively connected with the drill bit 126. The BHA 124 may also include one or more downhole tools 180, 181 connected above and/or below the mud motor 182.

One or more of the downhole tools 180, 181 may be or comprise a directional drilling tool, such as a bent sub operable to facilitate slide drilling or a rotary steerable system (RSS) operable to facilitate directional drilling while continuously rotating the drill string 120 from the surface (e.g., via the top drive 116). One or more of the downhole tools 180, 181 may be or comprise a measurement-while-drilling (MWD) or logging-while-drilling (LWD) tools comprising downhole sensors 184 operable for the acquisition of measurement data pertaining to the BHA 124, the wellbore 102, and/or the formation 106. The downhole sensors 184 may comprise an inclination sensor, a rotational position sensor, and/or a rotational speed sensor, which may include one or more accelerometers, magnetometers, gyroscopic sensors (e.g., micro-electro-mechanical system (MEMS) gyros), and/or other sensors for determining the orientation, position, and/or speed of one or more portions of the BHA 124 (e.g., the drill bit 126, the downhole tools 180, 181, and/or the mud motor 182) and/or other portions of the drill string 120 relative to the wellbore 102 and/or the wellsite surface 104. The downhole sensors 184 may comprise a depth correlation sensor utilized to determine and/or log position (i.e., depth) of one or more portions of the BHA 124 and/or other portions of the drill string 120 within the wellbore 102 and/or with respect to the wellsite surface 104. One or more of the downhole tools 180, 181 may be or comprise a power generating sub having a mud-powered turbine operable to generate electrical power to energize one or more of the electrical devices of the BHA 124.

One or more of the downhole tools 180, 181 may comprise a telemetry device 186 operable to communicate with the surface equipment 110, such as via mud-pulse telemetry, electromagnetic telemetry, and/or other telemetry means. One or more of the downhole tools 180, 181 and/or other portion(s) of the BHA 124 may also comprise a downhole controller 188 operable to receive, process, and/or store data received from the surface equipment 110, the downhole sensors 184, and/or other portions of the BHA 124. The controller 188 may also store executable computer programs (e.g., program code instructions), including for implementing one or more aspects of the operations described herein.

The support structure 112 may support the top drive 116, operable to connect with an upper end of the drill string 120, and to impart rotary motion 117 and vertical motion 135 to the drill string 120, including the drill bit 126. However, another driver, such as a kelly and a rotary table (neither shown), may be utilized in addition to or instead of the top drive 116 to impart the rotary motion 117 to the drill string 120.

The torque sensor 128 (e.g., a torque sub) may be mechanically connected or otherwise disposed between an upper end of the drill string 120 and a drive shaft 125 of the top drive 116. The torque sensor 128 may be operable to output torque sensor data (e.g., torque signals or measurements) indicative of torque applied by the top drive 116 to the drill string 120. The torque sensor 128 may also facilitate determination of rotational position, rotational distance, rotational speed, and rotational acceleration of the drive shaft 125.

The top drive 116 may be suspended from (supported by) the support structure 112 via a hoisting system operable to impart vertical motion 135 to the top drive 116 and the drill string 120 connected to the top drive 116. During drilling operations, the top drive 116, in conjunction with operation of the hoisting system, may advance the drill string 120 into the formation 106 to form the wellbore 102. The hoisting system may comprise a traveling block 113, a crown block 115, and a drawworks 118 storing a flexible line 123 (e.g., a cable, a wire rope, etc.). The crown block 115 may be connected to and supported by the support structure 112, and the traveling block 113 may be connected to and support the top drive 116. The drawworks 118 may be mounted to the rig floor 114. The crown block 115 and traveling block 113 comprise pulleys or sheaves around which the flexible line 123 is reeved to operatively connect the crown block 115, the traveling block 113, and the drawworks 118. The drawworks 118 may comprise a drum and an electric motor (not shown) operatively connected with and operable to rotate the drum. The drawworks 118 may selectively impart tension to the flexible line 123 to lift and lower the top drive 116, resulting in the vertical movement 135 of the top drive 116 and the drill string 120 (when connected with the top drive 116). The drawworks 118 may be operable to reel in the flexible line 123, causing the traveling block 113 and the top drive 116 to move upward. The drawworks 118 may be further operable to reel out the flexible line 123, causing the traveling block 113 and the top drive 116 to move downward.

The top drive 116 may comprise a grabber, a swivel (neither shown), elevator links 127 terminating with an elevator 129, and a drive shaft 125 operatively connected with a prime mover (e.g., an electric motor) (not shown) of the top drive 116, such as via a gear box or transmission (not shown). The drive shaft 125 may be selectively coupled with the upper end of the drill string 120 (perhaps indirectly via the torque sub 128) and the prime mover may be selectively operated to rotate the drive shaft 125 and the drill string 120 coupled with the drive shaft 125. The elevator links 127 and the elevator 129 of the top drive 116 may handle tubulars (e.g., joints and/or stands of drill pipe, drill collars, casing, etc.) that are not mechanically coupled to the drive shaft 125. For example, when the drill string 120 is being tripped into or out of the wellbore 102, the elevator 129 may grasp the tubulars of the drill string 120 such that the tubulars may be raised and/or lowered via the hoisting equipment mechanically coupled to the top drive 116. The top drive 116 may have a guide system (not shown), such as rollers that track up and down a guide rail on the support structure 112. The guide system may aid in keeping the top drive 116 aligned with the wellbore 102, and in preventing the top drive 116 from rotating during drilling by transferring reactive torque to the support structure 112.

The well construction system 100 may further include a drilling fluid circulation system or equipment operable to circulate fluids between the surface equipment 110 and the drill bit 126 during drilling and other operations. For example, the drilling fluid circulation system may be operable to inject a drilling fluid from the wellsite surface 104 into the wellbore 102 via an internal fluid passage 121 extending longitudinally through the drill string 120. The drilling fluid circulation system may comprise a pit, a tank, and/or other fluid container 142 holding the drilling fluid 140 (i.e., drilling mud), and one or more pumps 144 operable to move the drilling fluid 140 from the container 142 into the fluid passage 121 of the drill string 120 via a fluid conduit 145 (e.g., a stand pipe) extending from the pump 144 to the top drive 116 and an internal passage extending through the top drive 116 (not shown).

During drilling operations, the drilling fluid may continue to flow downhole through the internal passage 121 of the drill string 120, as indicated by directional arrow 158. The drilling fluid may exit the BHA 124 via ports in the mud motor 182 and/or drill bit 126 and then circulate uphole through an annular space 108 of the wellbore 102 defined between an exterior of the drill string 120 and the sidewall of the wellbore 102, such flow being indicated in FIG. 1 by directional arrows 159. In this manner, the drilling fluid lubricates the drill bit 126 and carries formation cuttings uphole to the wellsite surface 104. The drilling fluid flowing downhole through the internal passage 121 may selectively actuate the mud motor 182 to rotate the drill bit 126 instead of or in addition to the rotation of the drill string 120 via the top drive 116. Accordingly, rotation of the drill bit 126 caused by the top drive 116 and/or mud motor 182, in conjunction with the weight-on-bit (WOB), may advance the drill string 120 through the formation 106 to form the wellbore 102.

The well construction system 100 may further include fluid control equipment 130 for maintaining well pressure control and for controlling fluid being discharged from the wellbore 102. The fluid control equipment 130 may be mounted on top of a wellhead 134. The drilling fluid flowing uphole 159 toward the wellsite surface 104 may exit the annulus 108 via one or more components of the fluid control equipment 130, such as a bell nipple, a rotating control device (RCD), and/or a ported adapter (e.g., a spool, a cross adapter, a wing valve, etc.). The drilling fluid may then pass through drilling fluid reconditioning equipment 170 to be cleaned and reconditioned before returning to the fluid container 142. The drilling fluid reconditioning equipment 170 may also separate drill cuttings 146 from the drilling fluid into a cuttings container 148.

The surface equipment 110 of the well construction system 100 may also comprise a control center 190 from which various portions of the well construction system 100, such as a drill string rotation system (e.g., the top drive 116), a hoisting system (e.g., the drawworks 118 and the blocks 113, 115), a drilling fluid circulation system (e.g., the mud pump 144 and the fluid conduit 145), a drilling fluid cleaning and reconditioning system (e.g., the drilling fluid reconditioning equipment 170 and the containers 142, 148), the well control system (e.g., a BOP stack, a choke manifold, and/or other components of the fluid control equipment 130), and the BHA 124, among other examples, may be monitored and controlled. The control center 190 may be located on the rig floor 114 or another location of the well construction system 100, such as the wellsite surface 104. The control center 190 may comprise a facility 191 (e.g., a room, a cabin, a trailer, a truck or other service vehicle, etc.) containing a control workstation 197, which may be operated by rig personnel 195 (e.g., a driller or other human rig operator(s)) to monitor and control various wellsite equipment and/or portions of the well construction system 100. The control workstation 197 may comprise or be communicatively connected with a surface equipment controller 192 (e.g., a processing device, a computer, etc.), such as may be operable to receive, process, and output information to monitor operations of and provide control to one or more portions of the well construction system 100. For example, the controller 192 may be communicatively connected with the surface equipment 110 and downhole equipment 120 described herein, and may be operable to receive signals (e.g., sensor data, sensor measurements, etc.) from and transmit signals (e.g., control data, control signals, control commands, etc.) to the equipment to perform various operations described herein. The controller 192 may store executable program code, instructions, and/or operational parameters or set-points, including for implementing one or more aspects of methods and operations described herein. The controller 192 may be located within and/or outside of the facility 191.

The control workstation 197 may be operable for entering or otherwise communicating control commands to the controller 192 by the rig personnel 195, and for displaying or otherwise communicating information from the controller 192 to the rig personnel 195. The control workstation 197 may comprise one or more input devices 194 (e.g., one or more keyboards, mouse devices, joysticks, touchscreens, etc.) and one or more output devices 196 (e.g., one or more video monitors, touchscreens, printers, audio speakers, etc.). Communication between the controller 192, the input and output devices 194, 196, and components of the wellsite equipment may be via wired and/or wireless communication means. However, for clarity and ease of understanding, such communication means are not depicted, and a person having ordinary skill in the art will appreciate that such communication means are within the scope of the present disclosure.

Well construction systems within the scope of the present disclosure may include more or fewer components than as described above and depicted in FIG. 1. Additionally, various equipment and/or subsystems of the well construction system 100 shown in FIG. 1 may include more or fewer components than as described above and depicted in FIG. 1. For example, various engines, motors, hydraulics, actuators, valves, and/or other components not explicitly described herein may be included in the well construction system 100 and are within the scope of the present disclosure.

Figure 2:
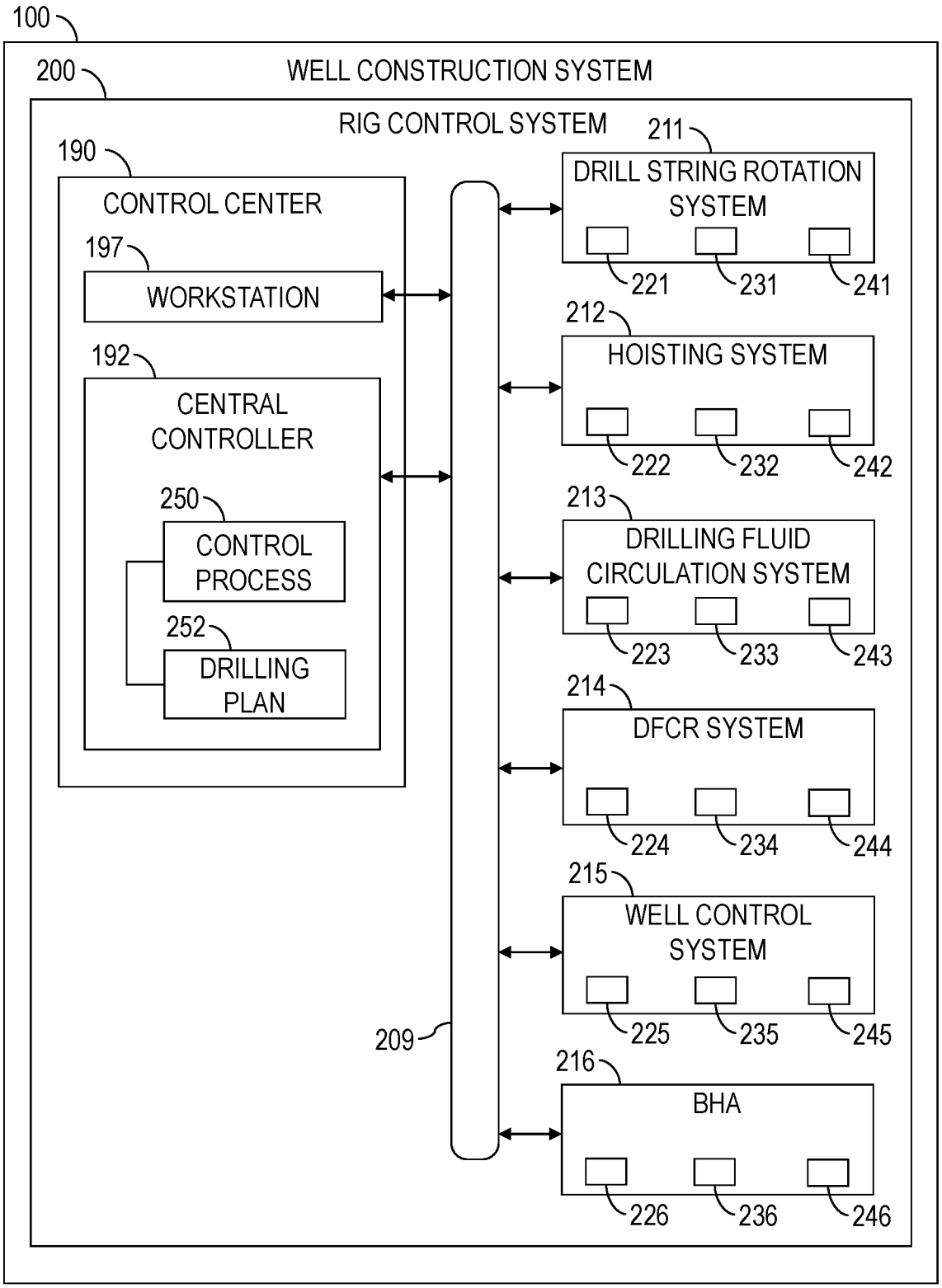
FIG. 2 is a schematic view of at least a portion of an example implementation of a rig control system according to one or more aspects of the present disclosure.

The present disclosure further provides various implementations of systems and/or methods for controlling one or more portions of the well construction system 100. FIG. 2 is a schematic view of at least a portion of an example implementation of a drilling rig control system 200 (hereinafter "rig control system") for monitoring and controlling various equipment, portions, and subsystems of the well construction system 100 shown in FIG. 1. The rig control system 200 may comprise one or more features of the well construction system 100, including where indicated by the same reference numerals. Accordingly, the following description refers to FIGS. 1 and 2, collectively. However, the rig control system 200 depicted in FIG. 2, as well as other implementations of rig control systems also within the scope of the present disclosure, may also be applicable or readily adapted for utilization with other implementations of well construction systems also within the scope of the present disclosure.

The various pieces of well construction equipment described above and shown in FIGS. 1 and 2 may each comprise one or more actuators (e.g., combustion, hydraulic, and/or electrical), which when operated may cause the corresponding well construction equipment to perform intended actions (e.g., work, tasks, movements, operations, etc.). Each piece of well construction equipment may further carry or comprise one or more sensors disposed in association with a corresponding actuator or another portion of the piece of equipment. Each sensor may be communicatively connected with a corresponding equipment controller and operable to generate sensor data (e.g., electrical sensor signals or measurements) indicative of an operational (e.g., mechanical or physical) status of the corresponding actuator or component, thereby permitting the operational status of the actuator to be monitored by the equipment controller. The sensor data may be utilized by the equipment controller as feedback data, permitting operational control of the piece of well construction equipment and coordination with other well construction equipment. Such sensor data may be indicative of performance of each individual actuator and, collectively, of the entire piece of well construction equipment.

The rig control system 200 may be in real-time communication with one or more components, subsystems, systems, and/or other equipment of the well construction system 100 that are monitored and/or controlled by the rig control system 200. As described above, the equipment of the well construction system 100 may be grouped into several subsystems, each operable to perform a corresponding operation and/or a portion of the well construction operations described herein. For example, the subsystems may include a drill string rotation system 211 (e.g., the top drive 116), a hoisting system 212 (e.g., the drawworks 118 and the blocks 113, 115), a drilling fluid circulation system 213 (e.g., the mud pump 144 and the fluid conduit 145), a drilling fluid cleaning and reconditioning (DFCR) system 214 (e.g., the drilling fluid reconditioning equipment 170 and the containers 142, 148), a well control system 215 (e.g., a BOP stack, a choke manifold, and/or other components of the fluid control equipment 130), and the BHA 124 (designated in FIG. 2 by reference number 216), among other examples. The control workstation 197 may be utilized by rig personnel to monitor, configure, control, and/or otherwise operate one or more of the subsystems 211-216.

Each of the well construction subsystems 211-216 may further comprise various communication equipment (e.g., modems, network interface cards, etc.) and communication conductors (e.g., cables) communicatively connecting the equipment (e.g., sensors and actuators) of each subsystem 211-216 with the control workstation 197 and/or other equipment. Although the well construction equipment described above and shown in FIG. 1 is associated with certain wellsite subsystems 211-216, such associations are merely examples that are not intended to limit or prevent such well construction equipment from being associated with two or more of the wellsite subsystems 211-216 and/or different wellsite subsystems 211-216.

One or more of the subsystems 211-216 may include one or more local controllers 221-226, each operable to control various well construction equipment of the corresponding subsystem 211-216 and/or an individual piece of well construction equipment of the corresponding subsystem 211-216. Each well construction subsystem 211-216 includes various well construction equipment comprising corresponding actuators 241-246 for performing operations of the well construction system 100. One or more of the subsystems 211-216 may include various sensors 231-236 operable to generate or output sensor data (e.g., signals, information, measurements, etc.) indicative of operational status of the well construction equipment of the corresponding subsystem 211-216. Each local controller 221-226 may output control data (e.g., commands, signals, information, etc.) to one or more actuators 241-246 to perform corresponding actions of a piece of equipment of the corresponding subsystem 211-216. One or more of the local controllers 221-226 may receive sensor data generated by one or more corresponding sensors 231-236 indicative of operational status of an actuator or another portion of a piece of equipment of the corresponding subsystem 211-216. Although the local controllers 221-226, the sensors 231-236, and the actuators 241-246 are each shown as a single block, it is to be understood that each local controller 221-226, sensor 231-236, and actuator 241-246 may illustratively represent a plurality of local controllers, sensors, and actuators.

The sensors 231-236 may include sensors utilized for operation of the various subsystems 211-216 of the well construction system 100. For example, the sensors 231-236 may include cameras, position sensors, pressure sensors, temperature sensors, flow rate sensors, vibration sensors, current sensors, voltage sensors, resistance sensors, gesture detection sensors or devices, voice actuated or recognition devices or sensors, and/or other examples. The sensor data may include signals, information, and/or measurements indicative of equipment operational status (e.g., on or off, up or down, set or released, etc.), drilling parameters (e.g., depth, hook load, torque, etc.), auxiliary parameters (e.g., vibration data of a pump), flow rate, temperature, operational speed, position, and pressure, among other examples. The acquired sensor data may include or be associated with a timestamp (e.g., date and/or time) indicative of when the sensor data was acquired. The sensor data may also or instead be aligned with a depth or other drilling parameter.

For example, the sensors 231 may comprise one or more rotation sensors operable to output or otherwise facilitate rotational position, rotational speed, and/or rotational acceleration measurements of the top drive 116 (e.g., the drive shaft 125) indicative of rotational position, rotational speed, and/or rotational acceleration of the upper end of the drill string 120 connected to the top drive 116. The sensors 231 may also comprise one or more torque sensors (e.g., the torque sub 128) operable to facilitate torque measurements indicative of torque output by the top drive 116 to the top of the drill string 120. The torque sensors may also or instead be or comprise a variable frequency drive (VFD) supplying electrical power to the top drive 116, whereby torque output by the top drive 116 to the drill string 120 may be measured or otherwise determined based on measurements of electrical current transmitted to the top drive 116 by the VFD. The sensors 232 may comprise one or more rotation sensors operable to output or otherwise facilitate rotational position, rotational speed, and/or rotational acceleration measurements of the drawworks 118 indicative of vertical position, vertical speed, and/or vertical acceleration of the traveling block 113 and the drill string 120 (including the BHA 124) connected to the travelling block 113 via the top drive 116. The sensors 233 may comprise one or more pressure sensors operable to facilitate pressure measurements indicative of pressure of the drilling fluid being pumped downhole by the mud pumps 144 via the internal fluid passage 121 of the drill string 120. The pressure sensors may be disposed at the outlets of the pumps 144 and/or along the fluid conduit 145.

The local controllers 221-226, the sensors 231-236, and the actuators 241-246 may be communicatively connected with a central controller 192. For example, the local controllers 221-226 may be in communication with the sensors 231-236 and actuators 241-246 of the corresponding subsystems 211-216 via local communication networks (e.g., field buses) (not shown) and the central controller 192 may be in communication with the subsystems 211-216 via a central communication network 209 (e.g., a data bus, a field bus, a wide-area-network (WAN), a local-area-network (LAN), etc.). The sensor data generated by the sensors 231-236 of the subsystems 211-216 may be made available for use by the central controller 192 and/or the local controllers 221-226. Similarly, control data output by the central controller 192 and/or the local controllers 221-226 may be automatically communicated to the various actuators 241-246 of the subsystems 211-216, perhaps pursuant to predetermined programming, such as to facilitate well construction operations and/or other operations described herein. Although the central controller 192 is shown as a single device (i.e., a discrete hardware component), it is to be understood that the central controller 192 may be or comprise a plurality of equipment controllers and/or other electronic devices collectively operable to perform operations (i.e., computational processes or methods) described herein.

The sensors 231-236 and actuators 241-246 may be monitored and/or controlled by corresponding local controllers 221-226 and/or the central controller 192. For example, the central controller 192 may be operable to receive sensor data from the sensors 231-236 of the subsystems 211-216 in real-time, and to output real-time control data directly to the actuators 241-246 of the subsystems 211-216 based on the received sensor data. However, certain operations of the actuators 241-246 of one or more of the subsystems 211-216 may be controlled by a corresponding local controller 221-226, which may control the actuators 241-246 based on sensor data received from the sensors 231-236 of the corresponding subsystem 211-216 and/or based on control data received from the central controller 192.

The rig control system 200 may be a tiered control system, wherein control of the subsystems 211-216 of the well construction system 100 may be provided via a first tier of the local controllers 221-226 and a second tier of the central controller 192. The central controller 192 may facilitate control of one or more of the subsystems 211-216 at the level of each individual subsystem 211-216. For example, in the hoisting system 212, sensor data may be fed into the local controller 222, which may respond to control the actuators 242. However, for control operations that involve more than one of the subsystems 211-216, the control may be coordinated through the central controller 192 operable to coordinate control of well construction equipment of two, three, four, or more (each) of the subsystems 211-216.

The downhole controller 188, the central controller 192, the local controllers 221-226, and/or other controllers or processing devices (individually or collectively referred to hereinafter as an "equipment controller") of the rig control system 200 may each or collectively be operable to receive and store machine-readable and executable program code instructions (e.g., computer program code, algorithms, programmed processes or operations, etc.) on a memory device (e.g., a memory chip) and then execute the program code instructions to run, operate, or perform a control process for monitoring and/or controlling the well construction equipment of the well construction system 100. The central controller 192 may run (i.e., execute) a control process 250 (e.g., a coordinated control process or another computer process) and each local controller 221-226 may run a corresponding control process (e.g., a local control process or another computer processor) (not shown). Two or more of the local controllers 221-226 may run their local control processes to collectively coordinate operations between well construction equipment of two or more of the subsystems 211-216.

The control process 250 of the central controller 192 may operate as a mechanization manager of the rig control system 190, such as by coordinating operational sequences of the well construction equipment of the well construction system 100. The control process of each local controller 221-226 may facilitate a lower (e.g., basic) level of control within the rig control system 200 to operate a corresponding piece of well construction equipment or a plurality of pieces of well construction equipment of a corresponding subsystem 211-216. Such control process may facilitate, for example, starting, stopping, and setting or maintaining an operating speed of a piece of well construction equipment.

The control process 250 of the central controller 192 may output control data directly to the actuators 241-246 to control the well construction operations. The control process 250 may also or instead output control data to the control process of one or more local controllers 221-226, wherein each control process of the local controllers 221-226 may then output control data to the actuators 241-246 of the corresponding subsystem 211-216 to control a portion of the well construction operations performed by that subsystem 211-216. Thus, the control processes of equipment controllers (e.g., the central controller 192 and/or the local controllers 221-226) of the rig control system 200 individually and collectively perform monitoring and control operations described herein, including monitoring and controlling well construction operations. The program code instructions forming the basis for the control processes described herein may comprise rules (e.g., algorithms) based upon the laws of physics for drilling and other well construction operations.

Each control process being run by an equipment controller of the rig control system 200 may receive and process (i.e., analyze) sensor data from one or more of the sensors 231-236 according to the program code instructions, and generate control data (i.e., control signals or information) to operate or otherwise control one or more of the actuators 241-246 of the well construction equipment. Equipment controllers within the scope of the present disclosure can include, for example, programmable logic controllers (PLCs), industrial computers (IPCs), personal computers (PCs), soft PLCs, variable frequency drives (VFDs), and/or other controllers or processing devices operable to store and execute program code instructions, receive sensor data, and output control data to cause operation of the well construction equipment based on the program code instructions, sensor data, and/or control data.

A control workstation 197 may be communicatively connected with the central controller 192 and/or the local controllers 221-226 via the communication network 209, such as to receive sensor data from the sensors 231-236 and transmit control data to the central controller 192 and/or the local controllers 221-226 to control the actuators 241-246. Accordingly, the control workstation 197 may be utilized by rig personnel (e.g., a driller) to monitor and control the actuators 241-246 and other portions of the subsystems 211-216 via the central controller 192 and/or local controllers 221-226.

The central controller 192 may comprise a memory device operable to receive and store a well construction plan 252 (e.g., a drilling plan) for drilling and/or otherwise constructing a planned well. The well construction plan 252 may include well specifications, drill string specifications, operational parameters, schedules, and other information indicative of the planned well and the well construction equipment of the well construction system 100. For example, the well construction plan 252 may include properties of the subterranean formation through which the planned well is to be drilled, the path (e.g., direction, curvature, orientation, etc.) along which the planned well is to be drilled through the formation, the depth (e.g., true vertical depth (TVD) or measured depth (MD)) of the planned well, operational specifications (e.g., power output, weight, torque capabilities, speed capabilities, dimensions, size, etc.) of the well construction equipment (e.g., top drive 116, mud pumps 144, downhole mud motor 182, etc.) that is planned to be used to construct the planned well, and/or specifications (e.g., diameter, length, weight, etc.) of tubulars (e.g., drill pipe) that are planned to be used to construct the planned well. The well construction plan 252 may further include planned operational parameters of the well construction equipment during the well construction operations, such as weight on bit (WOB), top drive rotational speed (e.g., measured in revolutions per minute (RPM)), and rate of penetration (ROP) as a function of wellbore depth.

Figure 3:
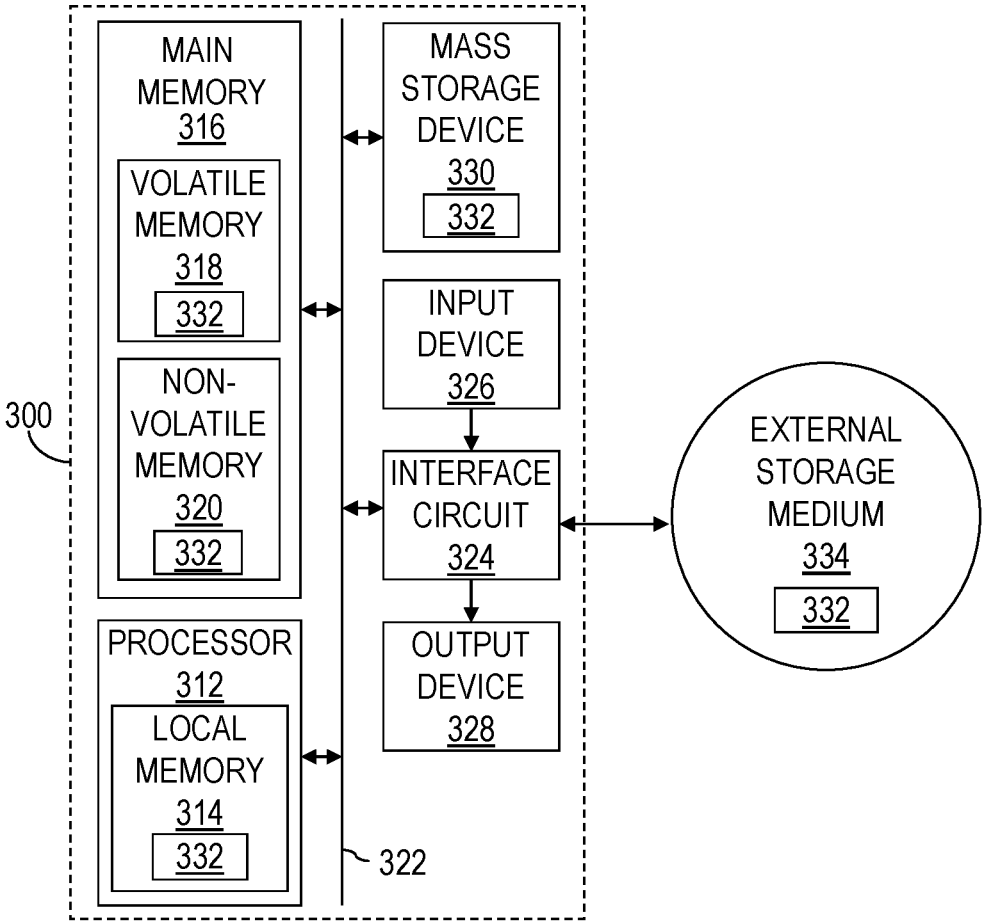
FIG. 3 is a schematic view of at least a portion of an example implementation of a processing system/device according to one or more aspects of the present disclosure.

FIG. 3 is a schematic view of at least a portion of an example implementation of a processing device 300 (or system) according to one or more aspects of the present disclosure. The processing device 300 may be or form at least a portion of one or more equipment controllers and/or other electronic devices shown in one or more of the FIGS. 1 and 2. Accordingly, the following description refers to FIGS. 1-3, collectively.

The processing device 300 may be or comprise, for example, one or more processors, controllers, special-purpose computing devices, PCs (e.g., desktop, laptop, and/or tablet computers), personal digital assistants, smartphones, IPCs, PLCs, servers, interne appliances, and/or other types of computing devices. One or more instances of the processing device 300 may be or form at least a portion of the rig control system 200. For example, one or more instances of the processing device 300 may be or form at least a portion of the downhole controller 188, the central controller 192, one or more of the local controllers 221-226, and/or the control workstation 197. Although it is possible that the entirety of the processing device 300 is implemented within one device, it is also contemplated that one or more components or functions of the processing device 300 may be implemented across multiple devices, some or an entirety of which may be at the wellsite and/or remote from the wellsite.

The processing device 300 may comprise a processor 312, such as a general-purpose programmable processor. The processor 312 may comprise a local memory 314 and may execute machine-readable and executable program code instructions 332 (i.e., computer program code) present in the local memory 314 and/or another memory device. The processor 312 may execute, among other things, the program code instructions 332 and/or other instructions and/or programs to implement the example methods and/or operations described herein. For example, the program code instructions 332, when executed by the processor 312 of the processing device 300, may cause the processor 312 to receive and process (e.g., compare) sensor data (e.g., sensor measurements) and output information indicative of accuracy of the sensor data, and thus the corresponding sensors according to one or more aspects of the present disclosure. The program code instructions 332, when executed by the processor 312 of the processing device 300, may also or instead cause one or more portions or pieces of well construction equipment of a well construction system to perform the example methods and/or operations described herein. The processor 312 may be, comprise, or be implemented by one or more processors of various types suitable to the local application environment, and may include one or more of general-purpose computers, special-purpose computers, microprocessors, digital signal processors (DSPs), field-programmable gate arrays (FPGAs), application-specific integrated circuits (ASICs), and processors based on a multi-core processor architecture, as non-limiting examples. Examples of the processor 312 include one or more INTEL microprocessors, microcontrollers from the ARM and/or PICO families of microcontrollers, embedded soft/hard processors in one or more FPGAs.

The processor 312 may be in communication with a main memory 316, such as may include a volatile memory 318 and a non-volatile memory 320, perhaps via a bus 322 and/or other communication means. The volatile memory 318 may be, comprise, or be implemented by random-access memory (RAM), static RAM (SRAM), dynamic RAM (DRAM), synchronous DRAM (SDRAM), RAMBUS DRAM (RDRAM), and/or other types of RAM devices. The non-volatile memory 320 may be, comprise, or be implemented by read-only memory, flash memory, and/or other types of memory devices. One or more memory controllers (not shown) may control access to the volatile memory 318 and/or non-volatile memory 320.

The processing device 300 may also comprise an interface circuit 324, which is in communication with the processor 312, such as via the bus 322. The interface circuit 324 may be, comprise, or be implemented by various types of standard interfaces, such as an Ethernet interface, a universal serial bus (USB), a third-generation input/output (3GIO) interface, a wireless interface, a cellular interface, and/or a satellite interface, among others. The interface circuit 324 may comprise a graphics driver card. The interface circuit 324 may comprise a communication device, such as a modem or network interface card to facilitate exchange of data with external computing devices via a network (e.g., Ethernet connection, digital subscriber line (DSL), telephone line, coaxial cable, cellular telephone system, satellite, etc.).

The processing device 300 may be in communication with various sensors, video cameras, actuators, processing devices, equipment controllers, and other devices of the well construction system via the interface circuit 324. The interface circuit 324 can facilitate communications between the processing device 300 and one or more devices by utilizing one or more communication protocols, such as an Ethernet-based network protocol (such as ProfiNET, OPC, OPC/UA, Modbus TCP/IP, EtherCAT, UDP multicast, Siemens S7 communication, or the like), a proprietary communication protocol, and/or another communication protocol.

One or more input devices 326 may also be connected to the interface circuit 324. The input devices 326 may permit rig personnel to enter the program code instructions 332, which may be or comprise control data, operational parameters, operational set-points, a well construction drill plan, and/or database of operational sequences. The program code instructions 332 may further comprise modeling or predictive routines, equations, algorithms, processes, applications, and/or other programs operable to perform example methods and/or operations described herein. The input devices 326 may be, comprise, or be implemented by a keyboard, a mouse, a joystick, a touchscreen, a track-pad, a trackball, an isopoint, and/or a voice recognition system, among other examples. One or more output devices 328 may also be connected to the interface circuit 324. The output devices 328 may permit for visualization or other sensory perception of various data, such as sensor data, status data, and/or other example data. The output devices 328 may be, comprise, or be implemented by video output devices (e.g., an LCD, an LED display, a CRT display, a touchscreen, etc.), printers, and/or speakers, among other examples. The one or more input devices 326 and the one or more output devices 328 connected to the interface circuit 324 may, at least in part, facilitate the HMIs described herein.

The processing device 300 may comprise a mass storage device 330 for storing data and program code instructions 332. The mass storage device 330 may be connected to the processor 312, such as via the bus 322. The mass storage device 330 may be or comprise a tangible, non-transitory storage medium, such as a floppy disk drive, a hard disk drive, a compact disk (CD) drive, and/or digital versatile disk (DVD) drive, among other examples. The processing device 300 may be communicatively connected with an external storage medium 334 via the interface circuit 324. The external storage medium 334 may be or comprise a removable storage medium (e.g., a CD or DVD), such as may be operable to store data and program code instructions 332.

As described above, the program code instructions 332 may be stored in the mass storage device 330, the main memory 316, the local memory 314, and/or the removable storage medium 334. Thus, the processing device 300 may be implemented in accordance with hardware (perhaps implemented in one or more chips including an integrated circuit, such as an ASIC), or may be implemented as software or firmware for execution by the processor 312. In the case of firmware or software, the implementation may be provided as a computer program product including a non-transitory, computer-readable medium or storage structure embodying computer program code instructions 332 (i.e., software or firmware) thereon for execution by the processor 312. The program code instructions 332 may include program instructions or computer program code that, when executed by the processor 312, may perform and/or cause performance of example methods, processes, and/or operations described herein.

During rotary drilling operations, just the top drive 116 or both the top drive 116 and the mud motor 182 may rotate the drill bit 126. When just the top drive 116 rotates the drill bit 126, the resulting average drill bit rotational rate is equal to the rotational rate of the top drive 116. When both the top drive 116 and the mud motor 182 rotate the drill bit 126, the resulting average drill bit rotational rate is equal to the sum of rotational rates of the top drive 116 and the mud motor 182.

During rotary drilling operations, a lower portion (i.e., the drill bit 126 and/or a portion of the BHA 124) of the drill string 120 may experience friction against the formation 106 in such a manner as to cause the lower portion of the drill string 120 to momentarily rotate at a slower speed than the speed of the top drive 116. Such slowdowns of the lower portion of the drill string 120 cause rotational lag and twisting of the drill string 120 between the lower portion of the drill string 120 and the top drive 116, resulting in torsional energy (i.e., torsional spring or elastic energy) being accumulated (i.e., stored, trapped, built up, etc.) in the drill string 120. Torsional energy in the drill string 120 may cause control problems during slide drilling operations or while trying to orient a toolface of the drill string 120. Torsional energy in the drill string 120 may cause an upper end (i.e., a stickup) of the drill string 120 to rotate when disconnected from the top drive 116, such as during or in preparation for drill pipe make up operations.

Furthermore, during rotary drilling operations, the lower portion of the drill string 120 may get stuck (e.g., jam or wedge) against the formation 106 in such a manner as to cause the lower portion of the drill string 120 to stop rotating, causing the mud motor 182 (when used) and then the top drive 116 to stall. For example, the drill bit 126, the mud motor 182, and/or the downhole tool 181 may get stuck against the formation 106 in such a manner that friction between the drill bit 126, the mud motor 182, and/or the downhole tool 181 and the formation 106 causes the lower portion of the drill string 120 to stop rotating. Telemetry signals indicative of a stuck event during which the lower portion of the drill string 120 becomes stuck against the subterranean formation 106 may take a relatively long time (e.g., several seconds to a minute or longer) to reach the surface equipment 110 to be detected by the central controller 192 and/or by rig personnel 195 via the workstation 197. Thus, before the stuck lower portion of the drill string 120 is detected, the top drive 116 may continue to rotate and twist the upper end of the drill string 120, resulting in torsional energy being accumulated in the drill string 120. Simultaneously, the mud motor 182 (if included in the BHA 124) may rotate and twist the lower end of the drill string 120 above the mud motor 182, resulting in further accumulation of torsional energy in the drill string 120 between the top drive 116 and the mud motor 182. The top drive 116 and the mud motor 182 may each stall (at the same or different times), after a sufficient amount of torsional energy is accumulated in the drill string 120.

The present disclosure is further directed to example methods (e.g., operations, processes, sequences, actions, etc.) for monitoring and controlling well construction equipment of a well construction system. The example methods may be performed utilizing or otherwise in conjunction with at least a portion of one or more implementations of one or more instances of the apparatus shown in one or more of FIGS. 1-3, and/or otherwise within the scope of the present disclosure. For example, the methods may be performed and/or caused, at least partially, by a processing device, such as the processing device 300 executing program code instructions 332 according to one or more aspects of the present disclosure. Thus, the present disclosure is also directed to a non-transitory, computer-readable medium comprising computer program code that, when executed by the processing device, may cause such processing device to perform the example methods described herein. The methods may also or instead be at least partially performed (or be caused to be performed) by a human user (e.g., rig personnel) utilizing one or more implementations of one or more instances of one or more components of the apparatus shown in one or more of FIGS. 1-3 and/or otherwise within the scope of the present disclosure. Accordingly, the following description refers to apparatus shown in one or more of FIGS. 1-3 and methods that can be performed by such apparatus. However, the methods may also be performed in conjunction with implementations of apparatus other than those depicted in FIGS. 1-3 that are also within the scope of the present disclosure.

Example methods within the scope of the present disclosure includes methods for monitoring the amount or level of torsional energy (hereinafter just "torque) accumulated in the drill string 120 during rotary drilling operations and, when the accumulated torque is detected within the drill string 120, automatically unwinding the drill string 120 to release the torque from the drill string 120. For example, a method according to one or more aspects of the present disclosure may include automatically detecting accumulation of torque in the drill string 120 based on measurements of torque output by the top drive 116 to the drill string 120 and in response, automatically initiating unwinding of the drill string 120 to release the torque accumulated in the drill string 120. A method according to one or more aspects of the present disclosure may include determining direction (i.e., polarity) of torque accumulated in the drill string 120 and then unwinding the drill string 120 based on the determined direction of torque. A method according to one or more aspects of the present disclosure may include determining speed at which the drill string 120 is to be unwound by the top drive 116, such as based on the amount of torque accumulated in the drill string 120. The unwinding speed may be determined such that the unwinding speed facilitates complete and/or quick unwinding of the drill string 120.

The present disclosure introduces a two-part approach for releasing torque accumulated in the drill string 120, including automatically detecting the torque accumulated in the drill string 120 and then unwinding the drill string 120. Automatic detection of the accumulated torque can be achieved by setting boundaries for rate of change of rotational speed of a top drive 116 and determining whether change of polarity (+/− sign) of the accumulated torque has been detected when the drill string 120 achieves a complete stop and starts to rotate in an opposing (e.g., reverse) direction. The consequent action of unwinding the drill string 120 includes unwinding the drill string 120 in a direction that is opposite from the direction of the accumulated torque at a speed determined dynamically based on the amount of torque that is accumulated in the drill string 120.

Figure 4:
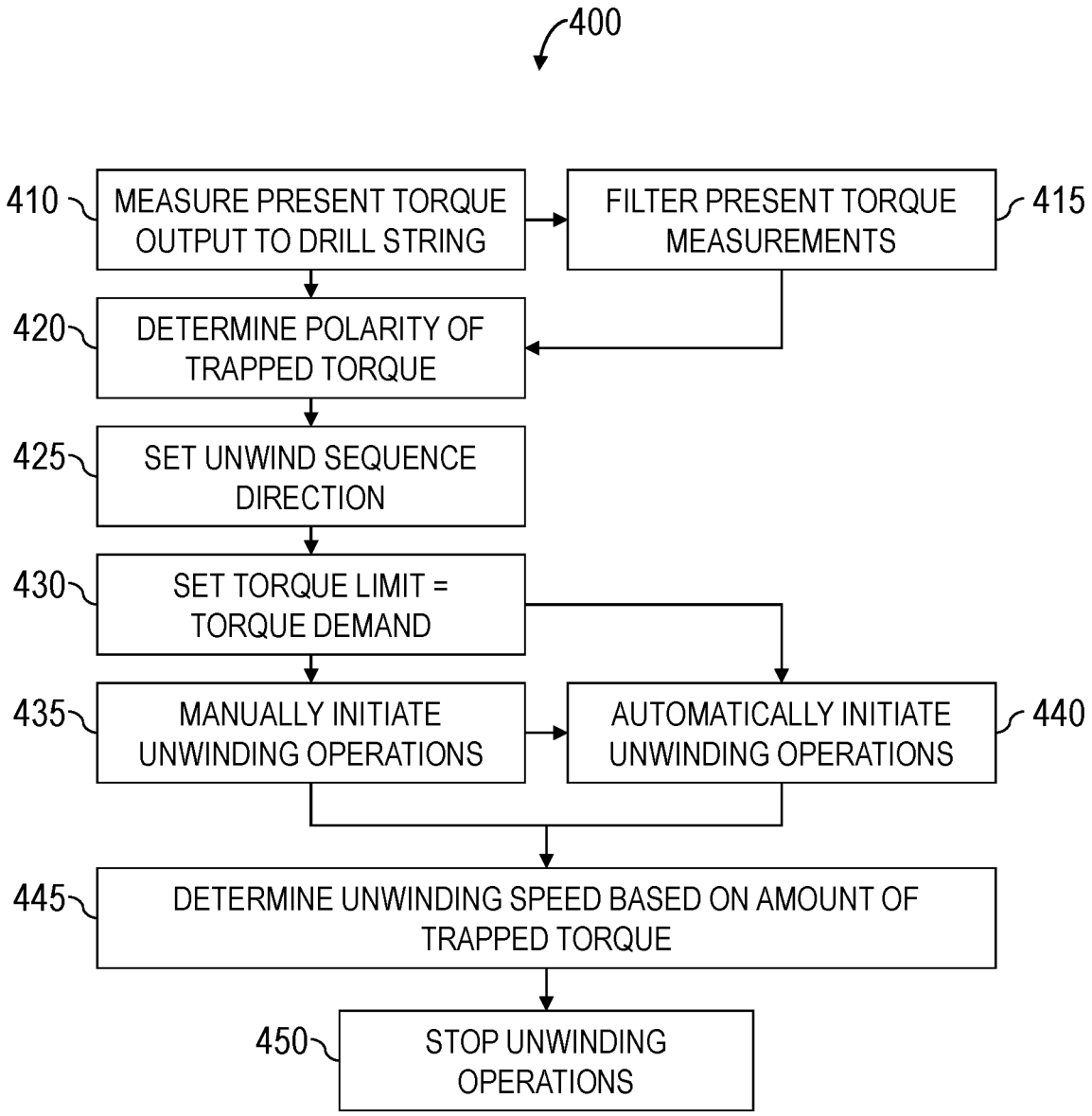
FIG. 4 is a flow-chart diagram of at least a portion of an example implementation of a method according to one or more aspects of the present disclosure.

FIG. 4 is a flow-chart diagram of at least a portion of an example implementation of a method 400 for automatically detecting the torque accumulated in the drill string 120 and then unwinding the drill string 120 to release the accumulated torque. The method 400 may be performed or otherwise implemented via or otherwise in conjunction with at least a portion of one or more implementations of one or more instances of the apparatus shown in one or more of FIGS. 1-3. Accordingly, the following description refers to FIGS. 1-4, collectively.

The method 400 may comprise measuring 410 present value of torque applied or output by the top drive 116 to the upper end of the drill string 120. The torque measurements may be output or otherwise facilitated by the torque sensor 128. The torque measurements may also or instead be determined by calculating torque output by an electric motor of the top drive 116, and then adjusting such torque based on mechanical properties of the top drive 116. The torque output by the electric motor may be measured or otherwise determined based on measurements of electrical current transmitted to the electric motor by an equipment controller (e.g., VFD) of the top drive 116. The measuring 410 of the present value of torque may be performed in real-time, continuously at regular or otherwise predetermined intervals. The method 400 may also comprise filtering 415 (e.g., low-pass, band-pass, etc.) of the torque measurements, perhaps utilizing predetermined values for the corresponding cutoff frequencies. The method 400 may further comprise determining 420 polarity (i.e., direction) of the torque accumulated in the drill string 120 based on the unfiltered or filtered 415 torque measurements, and then setting 425 direction of unwinding of the drill string 120 to a direction that is opposite to the determined polarity of the accumulated torque. The method 400 may further comprise setting 430 a limit to torque output by the top drive 116 to be equal to torque demand.

The method 400 may also comprise manually initiating 435 the unwinding operations (e.g., sequence) by a human operator (e.g., via operation of an HMI or other input device 326 of the processing system 300) by stopping rotation of the top drive 116 and triggering (i.e., turning on) the unwinding operations, thereby causing the top drive 116 to rotate the drill string 120 in the direction that is opposite to the determined polarity of the accumulated torque being unwound. The manual initiation 435 of the unwinding operations may be performed when switching between different modes of well construction operations (e.g., rotary drilling with the drill string 120, making/breaking connections of the drill string 120, orienting a toolface (e.g., the relative orientation/direction) of the drill bit 126 or other tool of the BHA 124, oscillating the drill string 120 (e.g., for slide drilling), etc.). Performing the manual initiation 435 when switching between operation modes may aid in ensuring that the accumulated torque is in safe operating conditions. The manual initiation 435 may also or instead be performed just when transitioning from either a rotary drilling mode or an orienting mode to a connection mode. The manual initiation 435 may also or instead be performed when shutting off the VFD that is driving the top drive 116.

The method 400 may also or instead comprise automatically initiating 440 the unwinding operations (e.g., sequence) by an equipment controller (e.g., the controller 192, the processing device 300, etc.) based on one or more operational parameters of or associated with the drill string rotation system 211 and/or the drill string 120. For example, the unwinding operations may be automatically initiated 440 when the conditions described by Equation (1), set forth below, are satisfied.

$$[\omega_0>0.0 \text{ and } \omega_1<0.0] \text{ or } [\omega_0<0.0 \text{ and } \omega_1>0.0] \text{ and } \text{abs}(d\omega/dt)>=a_0 \quad (1)$$

where $\omega$ is the current speed of the top drive 116, $\omega_0$ is the set nominal or average speed of the top drive 116, $\omega_1$ is an associated speed feedback value (e.g., actual speed of the top drive 116 based on speed feedback), and $a_0$ is the set nominal or average ramp rate (i.e., acceleration) for changing $\omega$. The speed setpoint $\omega_0$ is applied in the direction of the actual speed $\omega_1$, and a braking torque is generated to bring the top drive 116 to a speed control regime based on conditions described by Equation (1).

The method 400 may further comprise determining 445 the unwinding speed of the drill string 120 based on the amount of torque accumulated in the drill string 120. The unwinding speed may be determined dynamically during the unwinding operations by an equipment controller (e.g., a PI controller, a PID controller, etc.) based on the amount of torque accumulated in the drill string 120. The method 400 may further comprise stopping 450 the unwinding operations based on one or more factors. For example, the unwinding operations may be stopped 450 when the unwinding speed is determined to be not in speed control and has exceeded a configurable or otherwise predetermined unwind shutdown speed ($\omega_s$) limit, such as when conditions described by Equation (2), set forth below, are satisfied.

$$[\text{Pos. trapped torque: } \omega_0<0.0 \text{ and } \omega_1<-\omega_s] \text{ or } [\text{Neg. trapped torque: } \omega_0>0.0 \text{ and } \omega_1=>\omega_s] \quad (2)$$

The stopping 450 of the unwinding operations may also or instead be performed by a timer. For example, a current torque demand (T) may be measured during each cycle, and the timer may remain active if the current torque demand T remains the same when compared to a previous torque demand ($T_{prev}$) measured during a previous cycle or the change between the previous torque demand $T_{prev}$ and the current torque demand T is negligible based on (e.g., smaller than) a configurable or otherwise predetermined unwind torque change limit ($T_s$), such as in the example set forth below in Equation (3).

$$(T-T_{prev})<=T_s \quad (3)$$

After the timer has reached the configurable limit, a category zero (CAT-0) stop command may be output by the equipment controller to stop 450 the unwinding operations. For example, the CAT-0 stop command may cause a top drive brake to be applied and/or pulsed to release torque that may remain accumulated in the drill string 120 when the top drive 116 is cleared off an emergency stop condition. When the timer has lapsed and the torque accumulated in the drill string 120 has reached a predetermined (e.g., acceptable) level, the unwinding operations may be determined to be completed. One or more portions of the method 400 may be performed on a regular basis just before each time the well construction system 100 is turned off, including before the top drive controller (i.e., VFD) is turned off, so as to systematically release torque accumulated in the drill string 120.

Figure 5:
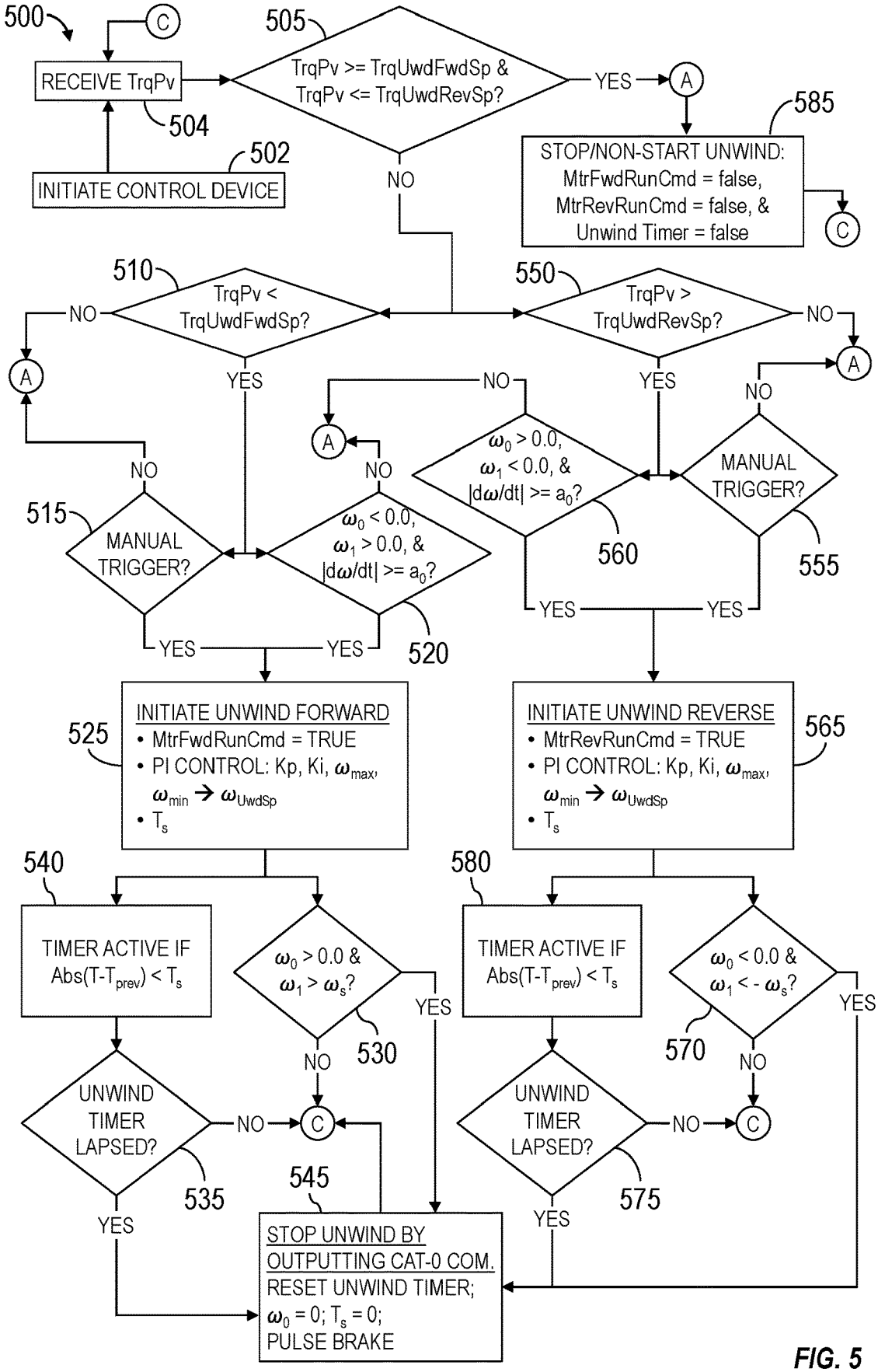
FIG. 5 is a flow-chart diagram of at least a portion of another example implementation of a method according to one or more aspects of the present disclosure.

FIG. 5 is a flow-chart diagram of at least a portion of an example implementation of the method 400 of detecting and unwinding torque accumulated in the drill string 120 shown in FIG. 4, designated in FIG. 5 as method 500. The method 500 may comprise one or more features (e.g., steps, actions, etc.) of the method 400 and may be performed or otherwise implemented via or otherwise in conjunction with at least a portion of one or more implementations of one or more instances of the apparatus shown in one or more of FIGS. 1-3. Accordingly, the following description refers to FIGS. 1-5, collectively.

The method 500 may comprise initiating 502 operation of a control device (e.g., the controller 192, the processing device 300, etc.) for controlling various portions (e.g., the top drive 116) of the well construction system 100 to perform drilling operations to form the wellbore 102. The method 500 further comprises using the operating control device to monitor for torque accumulated in the drill string 120 and, if such torque is detected, perform various operations to cause the top drive 116 and the drill string 120 to unwind and release the accumulated torque.

The monitoring operations of method 500 may comprise receiving 504 (and perhaps filtering) present value torque measurements TrqPv, such as may be output or otherwise facilitated by the torque sub 128 and/or the VFD of the top drive 116. The TrqPv measurements are compared 505 to a forward unwinding torque setpoint (TrqUwdFwdSp) and a reverse unwinding torque setpoint (TrqUwdRevSp) to determine if excessive torque has accumulated in the drill string. When the control device determines 505 that a present value torque measurement TrqPv is greater than or equal to TrqUwdFwdSp and less than or equal to TrqUwdRevSp (e.g., when TrqPv is determined 505 to be within the deadband between TrqUwdFwdSp and TrqUwdRevSp), then the control device determines that there is no accumulated torque in the drill string 120 and no unwinding is necessary. This is depicted in FIG. 5 by a "stop/non-start unwind" action 585, in which the control device may not start an unwinding operation if comparison 505 is satisfied, or a previously initiated unwinding operation is to be stopped, for reasons described below. The processing device may stop/non-start 585 the unwinding operation, for example, by setting a motor-forward-run command (MtfFwdRunCmd) sent to the top drive 116 to a value of false, setting a motor-reverse-run command (MtfRevRunCmd) to the top drive 116 to a value of false, and turning off the unwind timer by setting the unwind timer to a value of false.

If the comparison 505 is not satisfied, such that a received 504 TrqPv is less than TrqUwdFwdSp or greater than TrqUwdRevSp, thereby indicating that excessive torque has accumulated in the drill string, then the polarity of the accumulated torque is determined. That is, if TrqPv is less than TrqUwdFwdSp, the polarity is determined 510 to be negative, whereas if TrqPv is greater than TrqUwdRevSp, the polarity is determined 550 to be positive.

The forward unwinding operation 525 may be manually triggered 515 by a human operator or automatically triggered 520 (e.g., when conditions of Equation (1) set forth above are satisfied) by the control device. The forward unwinding operation 525 may comprise, for example, setting MtfFwdRunCmd sent by the control device to the top drive 116 to a value of true and dynamically determining the unwind speed setpoint $\omega_{UwdSp}$ sent by the control device to the top drive 116 based on a previously received or set proportional gain Kp, integral gain Ki, upper rotational speed limit $\omega_{max}$, and lower rotational speed limit $\omega_{min}$. The forward unwinding operation 525 continues until either the unwind timer 540 lapses 535 or it is determined 530 that $\omega_0$ is greater than zero while $\omega_1$ is not greater than $\omega_s$. In either case, the control device may then stop 545 the forward unwinding operation 525 by outputting the CAT-0 stop command. For example, the CAT-0 stop command may cause resetting the unwind timer, setting $\omega_0$ to zero, setting $T_s$ to zero, and engaging the top drive brake.

The reverse unwinding operation 565 may be manually triggered 555 by a human operator or automatically triggered 560 (e.g., when conditions of Equation (1) set forth above are satisfied) by the control device. The reverse unwinding operation 565 may comprise, for example, setting MtfRevRunCmd sent by the control device to the top drive 116 to a value of true and dynamically determining the unwind speed setpoint $\omega_{UwdSp}$ sent by the control device to the top drive 116 based on a previously received or set proportional gain Kp, integral gain Ki, upper rotational speed limit $\omega_{max}$, and lower rotational speed limit $\omega_{min}$. The reverse unwinding operation 565 continues until either the unwind timer 580 lapses 575 or it is determined 570 that $\omega_0$ is less than zero while $\omega_1$ is not less than $\omega_s$. In either case, the control device may then stop 545 the reverse unwinding operation 565 by outputting the CAT-0 stop command.

In view of the entirety of the present disclosure, including the figures and the claims, a person having ordinary skill in the art will readily recognize that the present disclosure introduces a method comprising: initiating operation of a control device to thereby receive measurements indicative of present value torque (TrqPv) currently being applied by a top drive to a drill string extending in a well that penetrates a subterranean formation; and utilizing the operating control device to release torque accumulated in the drill string by determining polarity of TrqPv and, in response to a manual or automatic trigger, causing the top drive to perform an unwinding operation in a direction opposite to the determined TrqPv polarity.

Determining the TrqPv polarity may comprise: determining polarity of the TrqPv as being negative when the TrqPv is less than a forward unwinding torque setpoint (TrqUwdFwdSp); and determining polarity of the TrqPv as being positive when the TrqPv is greater than a reverse unwinding torque setpoint (TrqUwdRevSp)).

The operating control device may generate the automatic trigger in response to the absolute value of present acceleration of the top drive not being less than a predetermined ramp rate ($a_0$) for changing present speed of the top drive ($\omega$) while either: when the TrqPv polarity is positive, present set speed of the top drive ($\omega_0$) is greater than zero while an associated speed feedback value ($\omega_1$) is less than zero; or when the TrqPv polarity is negative, $\omega_0$ is less than zero while $\omega_1$ is greater than zero.

Causing the top drive to perform the unwinding operation may comprise: (A) dynamically determining unwind speed setpoint ($\omega_{UwdSp}$) values utilizing a proportional gain (Kp), an integral gain (Ki), an upper speed limit for the top drive ($\omega_{max}$), and a lower speed limit for the top drive ($\omega_{min}$); and (B) sending the dynamically determined $\omega_{UwdSp}$ values to the top drive until either an unwind timer lapses or: (1) when the TrqPv polarity is negative, a present set speed of the top drive ($\omega_0$) is greater than zero while an associated speed feedback value ($\omega_1$) is greater than a predetermined unwind shutdown speed ($\omega_s$); or (2) when the TrqPv polarity is positive, $\omega_0$ is less than zero while $\omega_1$ is less than negative $\omega_s$ ($-\omega_s$). In such implementations, among others within the scope of the present disclosure, the initiated operation of the control device may also comprise receiving measurements indicative of torque demand during monitored cycles of the unwinding operation, and the unwind timer may lapse when the torque demands of two sequential ones of the cycles varies by more than a predetermined unwind torque change limit ($T_s$).

The TrqPv measurements may be received from at least one of: a torque sub connected between the top drive and the drill string; and a variable-frequency drive (VFD) operably connected with the top drive.

The method may further comprise, before determining the TrqPv polarity, determining that torque has accumulated in the drill string by determining that one of the TrqPv measurements is not less than a forward unwinding torque setpoint (TrqUwdFwdSp) and not greater than a reverse unwinding torque setpoint (TrqUwdRevSp).

The present disclosure also introduces an apparatus comprising: a torque sensor operable to facilitate torque measurements indicative of present value torque (TrqPv) currently being applied by a top drive to a drill string extending in a well that penetrates a subterranean formation; and a control device comprising a processor and a memory storing computer program code. The computer program code, when executed by the processor, causes the control device to receive the TrqPv measurements and release torque accumulated in the drill string by: determining polarity of TrqPv; and in response to a manual or automatic trigger, causing the top drive to perform an unwinding operation in a direction opposite to the determined TrqPv polarity.

Determining the TrqPv polarity may comprise: determining polarity of the TrqPv as being negative when the TrqPv is less than a forward unwinding torque setpoint (TrqUwdFwdSp); and determining polarity of the TrqPv as being positive when the TrqPv is greater than a reverse unwinding torque setpoint (TrqUwdRevSp)).

The computer program code, when executed by the processor, may further cause the control device to generate the automatic trigger in response to the absolute value of present acceleration of the top drive not being less than a predetermined ramp rate ($a_0$) for changing present speed of the top drive ($\omega$) while either: when the TrqPv polarity is positive, present set speed of the top drive ($\omega_0$) is greater than zero while an associated speed feedback value ($\omega_1$) is less than zero; or when the TrqPv polarity is negative, $\omega_0$ is less than zero while $\omega_1$ is greater than zero.

The computer program code, when executed by the processor, may cause the control device to control the top drive to perform the unwinding operation by: (A) dynamically determining unwind speed setpoint ($\omega_{UwdSp}$) values utilizing a proportional gain (Kp), an integral gain (Ki), an upper speed limit for the top drive ($\omega_{max}$), and a lower speed limit for the top drive ($\omega_{min}$); and (B) sending the dynamically determined $\omega_{UwdSp}$ values to the top drive until either an unwind timer lapses or: when the TrqPv polarity is negative, a present set speed of the top drive ($\omega_0$) is greater than zero while an associated speed feedback value ($\omega_1$) is greater than a predetermined unwind shutdown speed ($\omega_s$); or when the TrqPv polarity is positive, $\omega_0$ is less than zero while $\omega_1$ is less than negative $\omega_s$ ($-\omega_s$). The computer program code, when executed by the processor, may also cause the control device to receive measurements indicative of torque demand during monitored cycles of the unwinding operation, and the unwind timer may lapse when the torque demands of two sequential ones of the cycles varies by more than a predetermined unwind torque change limit ($T_s$).

The torque sensor may be operably associated with at least one of: a torque sub connected between the top drive and the drill string; and a variable-frequency drive (VFD) operably connected with the top drive.

The computer program code, when executed by the processor, may further cause the control device to, before determining the TrqPv polarity, determine that torque has accumulated in the drill string by determining that one of the TrqPv measurements is not less than a forward unwinding torque setpoint (TrqUwdFwdSp) and not greater than a reverse unwinding torque setpoint (TrqUwdRevSp).

The present disclosure also introduces a computer program product comprising a tangible, non-transitory, computer-readable medium having instructions stored thereon that, when executed by a processor of a control device, cause the control device to: receive measurements indicative of present value torque (TrqPv) currently being applied by a top drive to a drill string extending in a well that penetrates a subterranean formation; and release torque accumulated in the drill string by determining polarity of TrqPv and, in response to a manual or automatic trigger, causing the top drive to perform an unwinding operation in a direction opposite to the determined TrqPv polarity.

Determining the TrqPv polarity may comprise: determining polarity of the TrqPv as being negative when the TrqPv is less than a forward unwinding torque setpoint (TrqUwdFwdSp); and determining polarity of the TrqPv as being positive when the TrqPv is greater than a reverse unwinding torque setpoint (TrqUwdRevSp)).

The instructions, when executed by the processor, may further cause the control device to generate the automatic trigger in response to the absolute value of present acceleration of the top drive not being less than a predetermined ramp rate ($a_0$) for changing present speed of the top drive ($\omega$) while either: when the TrqPv polarity is positive, present set speed of the top drive ($\omega_0$) is greater than zero while an associated speed feedback value ($\omega_1$) is less than zero; or when the TrqPv polarity is negative, $\omega_0$ is less than zero while $\omega_1$ is greater than zero.

The instructions, when executed by the processor, may cause the control device to cause the top drive to perform the unwinding operation by: (A) dynamically determining unwind speed setpoint ($\omega_{UwdSp}$) values utilizing a proportional gain (Kp), an integral gain (Ki), an upper speed limit for the top drive ($\omega_{max}$), and a lower speed limit for the top drive ($\omega_{min}$); and (B) sending the dynamically determined $\omega_{UwdSp}$ values to the top drive until either an unwind timer lapses or: (1) when the TrqPv polarity is negative, a present set speed of the top drive ($\omega_0$) is greater than zero while an associated speed feedback value ($\omega_1$) is greater than a predetermined unwind shutdown speed ($\omega_s$); or (2) when the TrqPv polarity is positive, $\omega_0$ is less than zero while $\omega_1$ is less than negative $\omega_s$ ($-\omega_s$).

The instructions, when executed by the processor, may further cause the control device to receive measurements indicative of torque demand during monitored cycles of the unwinding operation, and the unwind timer may lapse when the torque demands of two sequential ones of the cycles varies by more than a predetermined unwind torque change limit ($T_s$).

The instructions, when executed by the processor, may further cause the control device to, before determining the TrqPv polarity, determine that torque has accumulated in the drill string by determining that one of the TrqPv measurements is not less than a forward unwinding torque setpoint (TrqUwdFwdSp) and not greater than a reverse unwinding torque setpoint (TrqUwdRevSp).

The foregoing outlines features of several embodiments so that a person having ordinary skill in the art may better understand the aspects of the present disclosure. A person having ordinary skill in the art should appreciate that they may readily use the present disclosure as a basis for designing or modifying other processes and structures for carrying out the same functions and/or achieving the same benefits of the embodiments introduced herein. A person having ordinary skill in the art should also realize that such equivalent constructions do not depart from the spirit and scope of the present disclosure, and that they may make various changes, substitutions and alterations herein without departing from the spirit and scope of the present disclosure.

What is claimed is:

1. A method comprising:

initiating operation of a control device to thereby receive measurements indicative of present value torque (TrqPv) currently being applied by a top drive to a drill string extending in a well that penetrates a subterranean formation; and utilizing the operating control device to release torque accumulated in the drill string by:

determining polarity of the TrqPv; and in response to a manual or automatic trigger, causing the top drive to perform an unwinding operation in a direction opposite to the determined TrqPv polarity, wherein the operating control device generates the automatic trigger in response to an absolute value of present acceleration of the top drive not being less than a predetermined ramp rate ($a_0$) for changing present speed of the top drive ($\omega$) while either:

when the TrqPv polarity is positive, present set speed of the top drive ($\omega_0$) is greater than zero while an associated speed feedback value ($\omega_1$) is less than zero; or when the TrqPv polarity is negative, the $\omega_0$ is less than zero while the $\omega_1$ is greater than zero.

2. The method of claim 1 wherein determining the TrqPv polarity comprises:

determining the polarity of the TrqPv as being negative when the TrqPv is less than a forward unwinding torque setpoint (TrqUwdFwdSp); and determining the polarity of the TrqPv as being positive when the TrqPv is greater than a reverse unwinding torque setpoint (TrqUwdRevSp).

3. The method of claim 1 wherein causing the top drive to perform the unwinding operation comprises:

dynamically determining unwind speed setpoint ($\omega_{UwdSp}$) values utilizing a proportional gain (Kp), an integral gain (Ki), an upper speed limit for the top drive ($\omega_{max}$), and a lower speed limit for the top drive ($\omega_{min}$); and sending the dynamically determined $\omega_{UwdSp}$ values to the top drive until either an unwind timer lapses or:

when the TrqPv polarity is negative, the present set speed of the top drive ($\omega_0$) is greater than zero while the associated speed feedback value ($\omega_1$) is greater than a predetermined unwind shutdown speed ($\omega_s$); or when the TrqPv polarity is positive, the $\omega_0$ is less than zero while the $\omega_1$ is less than negative $\omega_s$ ($-\omega_s$).

4. The method of claim 3 wherein:

the initiated operation of the control device also comprises receiving measurements indicative of torque demand during monitored cycles of the unwinding operation; and the unwind timer lapses when the torque demands of two sequential ones of the cycles varies by more than a predetermined unwind torque change limit ($T_s$).

5. The method of claim 1 wherein the TrqPv measurements are received from at least one of:

a torque sub connected between the top drive and the drill string; and a variable-frequency drive (VFD) operably connected with the top drive.

6. The method of claim 1 further comprising, before determining the TrqPv polarity, determining that the torque has accumulated in the drill string by determining that one of the TrqPv measurements is not less than a forward unwinding torque setpoint (TrqUwdFwdSp) and not greater than a reverse unwinding torque setpoint (TrqUwdRevSp).

7. An apparatus comprising:

a torque sensor operable to facilitate torque measurements indicative of present value torque (TrqPv) currently being applied by a top drive to a drill string extending in a well that penetrates a subterranean formation; and a control device comprising a processor and a memory storing computer program code that, when executed by the processor, causes the control device to receive the TrqPv measurements and release torque accumulated in the drill string by:

determining polarity of the TrqPv; and in response to a manual or automatic trigger, causing the top drive to perform an unwinding operation in a direction opposite to the determined TrqPv polarity, wherein the computer program code, when executed by the processor, further causes the control device to generate the automatic trigger in response to an absolute value of present acceleration of the top drive not being less than a predetermined ramp rate ($a_0$) for changing present speed of the top drive ($\omega$) while either:

when the TrqPv polarity is positive, present set speed of the top drive ($\omega_0$) is greater than zero while an associated speed feedback value ($\omega_1$) is less than zero; or when the TrqPv polarity is negative, the $\omega_0$ is less than zero while the on is greater than zero.

8. The apparatus of claim 7 wherein determining the TrqPv polarity comprises:

determining the polarity of the TrqPv as being negative when the TrqPv is less than a forward unwinding torque setpoint (TrqUwdFwdSp); and determining the polarity of the TrqPv as being positive when the TrqPv is greater than a reverse unwinding torque setpoint (TrqUwdRevSp).

9. The apparatus of claim 7 wherein the computer program code, when executed by the processor, causes the control device to control the top drive to perform the unwinding operation by:

dynamically determining unwind speed setpoint ($\omega_{UwdSp}$) values utilizing a proportional gain (Kp), an integral gain (Ki), an upper speed limit for the top drive ($\omega_{max}$), and a lower speed limit for the top drive ($\omega_{min}$); and sending the dynamically determined $\omega_{UwdSp}$ values to the top drive until either an unwind timer lapses or:

when the TrqPv polarity is negative, the present set speed of the top drive ($\omega_0$) is greater than zero while the associated speed feedback value ($\omega_1$) is greater than a predetermined unwind shutdown speed ($\omega_s$); or when the TrqPv polarity is positive, the $\omega_0$ is less than zero while the $\omega_1$ is less than negative $\omega_s$ ($-\omega_s$).

10. The apparatus of claim 9 wherein:

the computer program code, when executed by the processor, also causes the control device to receive measurements indicative of torque demand during monitored cycles of the unwinding operation; and the unwind timer lapses when the torque demands of two sequential ones of the cycles varies by more than a predetermined unwind torque change limit ($T_s$).

11. The apparatus of claim 7 wherein the torque sensor is operably associated with at least one of:

a torque sub connected between the top drive and the drill string; and a variable-frequency drive (VFD) operably connected with the top drive.

12. The apparatus of claim 7 wherein the computer program code, when executed by the processor, further causes the control device to, before determining the TrqPv polarity, determine that the torque has accumulated in the drill string by determining that one of the TrqPv measurements is not less than a forward unwinding torque setpoint (TrqUwdFwdSp) and not greater than a reverse unwinding torque setpoint (TrqUwdRevSp).

13. A computer program product comprising:

a tangible, non transitory, computer-readable medium having instructions stored thereon that, when executed by a processor of a control device, cause the control device to:

receive measurements indicative of present value torque (TrqPv) currently being applied by a top drive to a drill string extending in a well that penetrates a subterranean formation; and release torque accumulated in the drill string by:

determining polarity of the TrqPv; and in response to a manual or automatic trigger, causing the top drive to perform an unwinding operation in a direction opposite to the determined TrqPv polarity, wherein the instructions, when executed by the processor, further cause the control device to generate the automatic trigger in response to an absolute value of present acceleration of the top drive not being less than a predetermined ramp rate ($a_0$) for changing present speed of the top drive ($\omega$) while either:

when the TrqPv polarity is positive, present set speed of the top drive ($\omega_0$) is greater than zero while an associated speed feedback value ($\omega_1$) is less than zero; or when the TrqPv polarity is negative, the $\omega_0$ is less than zero while the $\omega_1$ is greater than zero.

14. The computer program product of claim 13 wherein determining the TrqPv polarity comprises:

determining the polarity of the TrqPv as being negative when the TrqPv is less than a forward unwinding torque setpoint (TrqUwdFwdSp); and determining the polarity of the TrqPv as being positive when the TrqPv is greater than a reverse unwinding torque setpoint (TrqUwdRevSp).

15. The computer program product of claim 13 wherein the instructions, when executed by the processor, cause the control device to cause the top drive to perform the unwinding operation by:

dynamically determining unwind speed setpoint ($\omega_{UwdSp}$) values utilizing a proportional gain (Kp), an integral gain (Ki), an upper speed limit for the top drive ($\omega_{max}$), and a lower speed limit for the top drive ($\omega_{min}$); and sending the dynamically determined $\omega_{UwdSp}$ values to the top drive until either an unwind timer lapses or:

when the TrqPv polarity is negative, the present set speed of the top drive ($\omega_0$) is greater than zero while the associated speed feedback value ($\omega_1$) is greater than a predetermined unwind shutdown speed ($\omega_s$); or when the TrqPv polarity is positive, the $\omega_0$ is less than zero while the $\omega_1$ is less than negative $\omega_s$ ($-\omega_s$).

16. The computer program product of claim 15 wherein:

the instructions, when executed by the processor, further cause the control device to receive measurements indicative of torque demand during monitored cycles of the unwinding operation; and the unwind timer lapses when the torque demands of two sequential ones of the cycles varies by more than a predetermined unwind torque change limit ($T_s$).

17. The computer program product of claim 13 wherein the instructions, when executed by the processor, further cause the control device to, before determining the TrqPv polarity, determine that the torque has accumulated in the drill string by determining that one of the TrqPv measurements is not less than a forward unwinding torque setpoint (TrqUwdFwdSp) and not greater than a reverse unwinding torque setpoint (TrqUwdRevSp).

* * * * *